US008197643B2

(12) United States Patent
Hedlund

(10) Patent No.: US 8,197,643 B2
(45) Date of Patent: Jun. 12, 2012

(54) REFINING SEGMENT FOR PULP PROCESSING WITH A DEFLECTOR ARRANGEMENT ATTACHED AT THE BARS SURFACES

(75) Inventor: Christer Hedlund, Katrineholm (SE)

(73) Assignee: Metso Paper Inc, Helsinki (FI)

( * ) Notice: Subject to any disclaimer, the term of this patent is extended or adjusted under 35 U.S.C. 154(b) by 0 days.

(21) Appl. No.: 12/990,679

(22) PCT Filed: Apr. 28, 2009

(86) PCT No.: PCT/SE2009/050447

§ 371 (c)(1),
(2), (4) Date: Nov. 2, 2010

(87) PCT Pub. No.: WO2009/136846

PCT Pub. Date: Nov. 12, 2009

(65) Prior Publication Data

US 2011/0042027 A1 Feb. 24, 2011

(30) Foreign Application Priority Data

May 6, 2008 (SE) ..... 0801008

(51) Int. Cl.
*D21B 1/32* (2006.01)

(52) U.S. Cl. ..... 162/261

(58) Field of Classification Search ..... 162/261; 241/291, 260, 261.2, 298, 245
See application file for complete search history.

(56) References Cited

U.S. PATENT DOCUMENTS

| | | | |
|---|---|---|---|
| 1,169,228 | A | 1/1916 | Barker |
| 3,473,745 | A | 10/1969 | Shook |
| 2007/0164143 | A1 | 7/2007 | Sabourin |

FOREIGN PATENT DOCUMENTS

| | | |
|---|---|---|
| EP | 1700949 | 9/2006 |
| WO | WO95/25199 | 9/1995 |
| WO | WO99/54046 | 10/1999 |
| WO | WO01/94021 | 12/2001 |
| WO | WO2005/070550 | 8/2005 |
| WO | WO2007/085703 | 8/2007 |

*Primary Examiner* — Mark Halpern
(74) *Attorney, Agent, or Firm* — Rolf Fasth; Fasth Law Offices

(57) ABSTRACT

A refining segment intended for refiners of disc-type for working fibrous material. A first portion has a first pattern of coarse bars and a second portion has a second pattern of fine bars. The second portion is positioned outside the first portion. The second pattern has a higher density of bars than the first pattern. The refining segment has a deflector arrangement protruding from a bar surface of the coarse bar. The bar surface faces the rotational direction. The deflector arrangement has a deflector surface directing a flow of fibrous material away from the bar surface. A refining apparatus has two opposing rotatable refining discs, separated by a refiner gap. At least one of the two refining discs has the above described patterns and deflector arrangements.

15 Claims, 2 Drawing Sheets

REFINING SEGMENT FOR PULP PROCESSING WITH A DEFLECTOR ARRANGEMENT ATTACHED AT THE BARS SURFACES

PRIOR APPLICATION

This application is a U.S. national phase application based on International Application No. PCT/SE2009/050447, filed 28 Apr. 2009 that claims priority from Swedish Patent Application No. 0801008-4, filed 6 May 2008.

TECHNICAL FIELD

The present invention relates in general to pulp processing, and in particular to arrangements in refiner apparatuses.

BACKGROUND AND SUMMARY OF THE INVENTION

Refining apparatuses are used in pulp processing for disintegrating and refining fibrous material, e.g. containing lignocelluloses. A typical refining apparatus for working fibrous material is a refiner of a disc-type. In such a refiner apparatus, two discs are rotated in relation to each other separated by a small refining gap. The discs are typically built up of refining segments, one or several, provided with patterns of bars and intermediate grooves that together form refining surfaces. The refining segments are replaced at regular intervals due to considerably wear. They are typically mounted directly on the rotor and stator, respectively, or by means of special segment holders. Refining apparatuses of this type are commonly used for many different types of refining, e.g. for processing of board pulp.

Fibrous material is typically introduced at the centre part of the discs and is refined in the refining gap when successively being transported to a peripheral edge of the discs by means of the forces created by the relative rotation. The discs are typically divided into different portions in radial direction. Closest to the rotational axis, an in-feeding portion is typically provided. Going outwards in the radial direction, the pattern of bars becomes successively denser and comprises typically narrower bars, at the same time as the refining gap is reduced. When changing from a portion with a less dense pattern to a portion with a denser pattern, there are considerations to be made. The flow of fibrous material tends to follow the sides, facing the relative rotational direction, of the coarse bars of the less dense pattern and when the flow meets the denser pattern, only a part of the pattern will initially be exposed for the main amount of the fibrous material. Due to this concentration of flow, the fine refining bars of the denser pattern in front of the ends of the coarse bars of the less dense pattern will experience a high wear. This is troublesome since the structure is relatively thin and has to be replaced relatively often. These effects are particularly noticeable when the change in pattern density is large between the different portions, e.g. what is usually the case in board pulp processing.

An object of the present invention is to provide refining arrangements with improved wear properties, and in particular wear properties in transition regions between portions having different pattern densities.

The above object is achieved by segments and arrangements according to the enclosed patent claims. In general words, in a first aspect, a refining segment, intended for refiners of disc-type for working fibrous material, comprises a first portion having a first pattern of coarse bars and a second portion having a second pattern of fine bars. The second portion is positioned outside the first portion in a radial direction. The second pattern has a higher density of bars than the first pattern. The refining segment further comprises at least one deflector arrangement, protruding from a bar surface of one of the coarse bars. The bar surface is the one facing the intended relative rotational direction. The deflector arrangement has a deflector surface directing a flow of fibrous material away from the bar surface.

In a second aspect, a refining apparatus for working of fibrous material has two opposing refining discs rotatable in relation to each other and separated by a refiner gap. At least one of the two refining discs comprises a first portion having a first pattern of coarse bars and a second portion having a second pattern of fine bars. The second portion is positioned outside the first portion in a radial direction. The second pattern has a higher density of bars than the first pattern. The refining apparatus further comprises at least one deflector arrangement, protruding from a bar surface of one of the coarse bars. The bar surface is the one facing the intended relative rotational direction. The deflector arrangement has a deflector surface directing a flow of fibrous material away from the bar surface.

One advantage with the devices according to the present invention is that the refining discs are provided with a diverger mechanism spreading the flow of fibrous material more evenly over the inlet part to the portion with denser bar pattern, thereby reducing the concentration of wear at limited parts of the fine bars.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
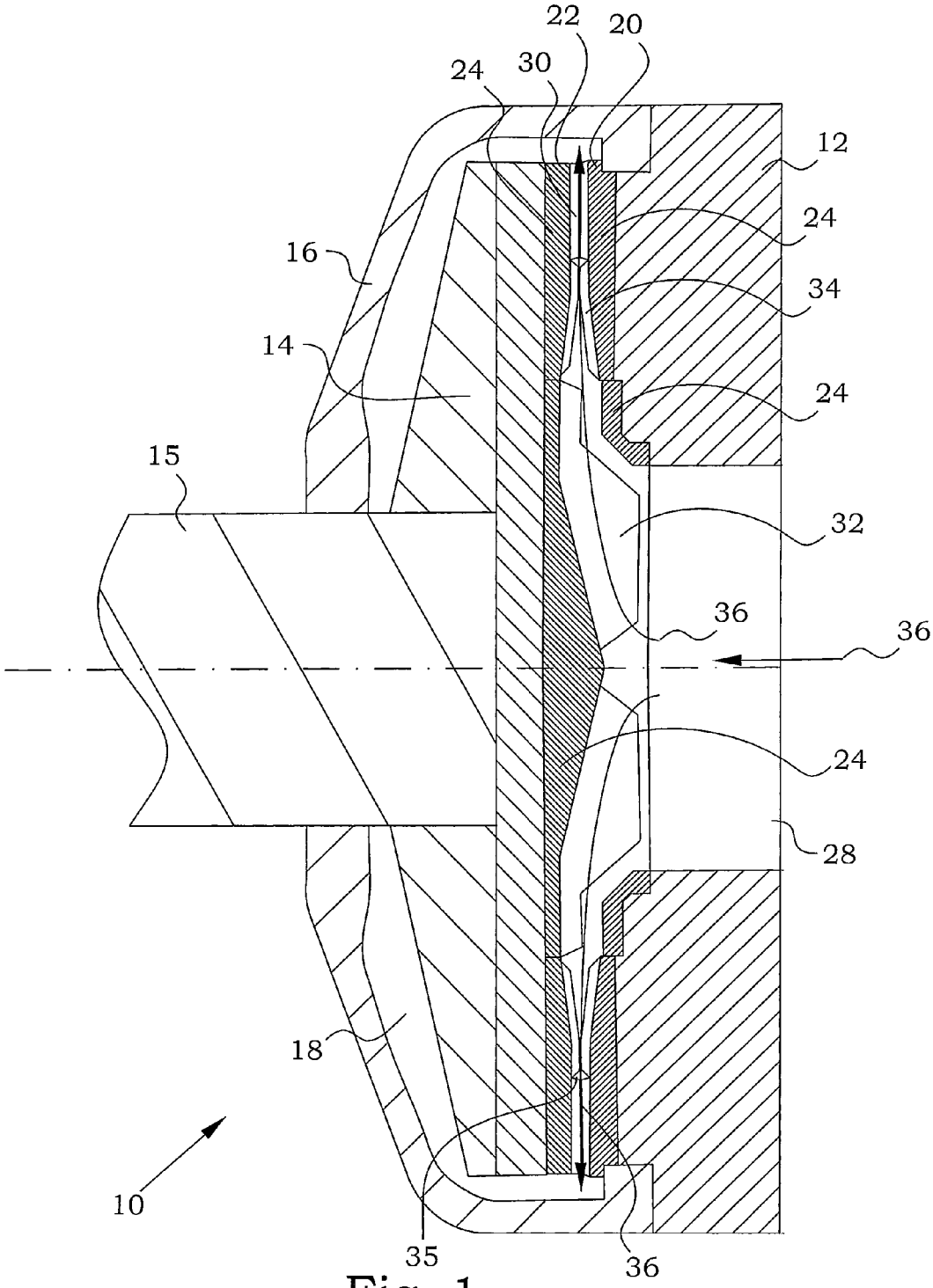
FIG. 1 is a cross-sectional view of an embodiment of a disc refiner.

FIG. 1 illustrates an embodiment of a disc refiner 10 comprising a stator 12 and a rotor 14. The rotor 14 is surrounded by a refiner housing 16, which together with the stator defines a volume 18 in which the rotor 14 rotates. Refining discs 20, 22 are mounted on the stator 12 and rotor 14, respectively. The refining discs 20, 22 are typically provided as refining segments 24 forming the surface of the refining discs 20, 22. A refining gap 30 is defined by the surfaces of the refining discs 20, 22, within which gap the actual refining process takes place.

Fibrous material is entered through a centre opening 28 in the stator. Guiding flanges 32 at a centre refining segment 26 assists the rotational forces to move the fibrous material outwards in a radial direction when the rotor 14 is rotated around its shaft 15. The surface of the refining discs 20, 22 in a radially outer portion are provided with different structures 34, assisting in guiding and/or working or refining the fibrous material. Such structures 34 are often provided as bar structures as will be discussed further below. The fibrous material is thus transported according to the arrows 36 and the refined material exits into the volume 18 and further through an outlet, not shown at the drawing.

The structures 34 are typically provided in a denser and denser pattern the further out on the disc the structures are provided 34. At certain positions, a transition 35 between a portion having a low density of bars and a portion having a higher density of bars will appear. As discussed in the background section, such transition 35 is associated with certain problems in prior art disc refiners.

Figure 2:
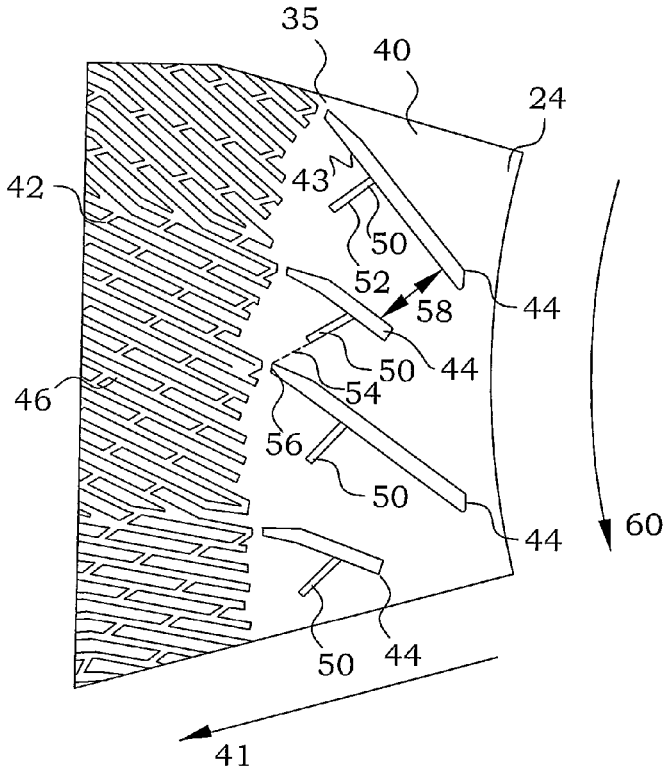
FIG. 2 is a top view of a part of an embodiment of a refining segment according to the present invention.

In FIG. 2, a part of an embodiment of a refining segment 24 according to the present invention is illustrated in a top view. A first portion 40 of the refining segment 24 has a first pattern of coarse bars 44. These coarse bars 44 are intended for guiding the fibrous material radially outwards and at the same time providing a first coarse working or refining of the fibrous material. The coarse bars 44 ends at a transition 35 into a second portion 42 of the refining segment 24. The second portion 42 has a second pattern of fine bars 46. The fine bars 46 are provided for further refining the fibrous material. The second portion 42 is thus positioned outside the first portion 40 in a radial direction 41. The exact design of the first and second patterns is preferably adapted to the type of fibrous material and the intended quality of resulting pulp. The details are generally not of particular importance for the operation of the present invention. However, the second pattern has a higher density of bars than the first pattern.

When rotated, as illustrated by the arrow 60, fibrous material will be brought radially outwards, and due to the rotation, most of the fibrous material will gather along the coarse bars 44 at a bar surface 43 facing the intended relative rotational direction 60. A deflector arrangement 50 is provided at the bar surface 43, which deflector arrangement 50 protrudes from the bar surface 43. The deflector arrangement 50 has a deflector surface 52, directing a flow of fibrous material away from the bar surface 43. The deflector arrangement 50 protrudes a non-negligible distance from the main bar surface 43. The distance, measured perpendicular to the bar surface 43 is preferably in the interval between ¼ and ¾ of a distance 58 between the respective coarse bar 44 and an adjacent coarse bar, adjacent in the relative rotational direction 60. The fibrous material is thereby brought out a significant distance from the coarse bar 44. When the fibrous material passes the end of the deflector arrangement 50, some material will have a tendency to continue along the tangential direction 54 of the deflector surface 52, while some material again returns towards the coarse bar 44. The result will be that the fibrous material is spread over a larger part of the transition 35 between the two portions 40, 42. By adapting the angle, length and position along the coarse bar of the deflector arrangement 50, the spreading efficiency can be optimized for different operational conditions.

In the particular embodiment of the present invention illustrated in FIG. 2, the deflector arrangement 50 has an essentially plane deflector surface 52. The tangential direction of the deflector surface 52, i.e. in this embodiment, the extension of the plane deflection surface aims essentially towards an outer end 56, in a radial direction 41, of an adjacent coarse bar, adjacent in the relative rotational direction 60. This gives a possibility for the fibrous material to reach the whole region between the two adjacent coarse bars.

The deflector arrangement 50 can be provided at selected coarse bars 44, but preferably, all coarse bars 44 are provided with a respective deflector arrangement 50. The deflector arrangements 50 are preferably manufactured together with the coarse bars 44 in one piece. However, it is also possible to provide them separately and mount them together.

Figure 3:
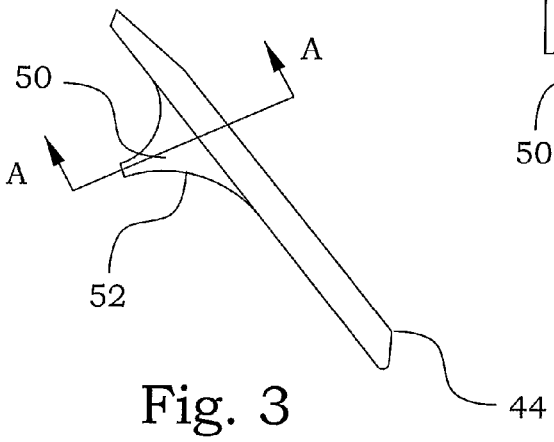
FIG. 3 is a schematic drawing of an embodiment of a deflector arrangement according to another embodiment of a refining segment according to the present invention.

FIG. 3 illustrates another embodiment of a coarse bar 44 according to the present embodiment. In this embodiment, the deflector surface 52 of the coarse bar 44 is a concave surface, which for certain fibrous material can give a smoother transition to the new enforced direction of flow. Also other geometries of the deflector arrangement 50 and in particular of the deflector surface 52 are possible.

Figure 4:
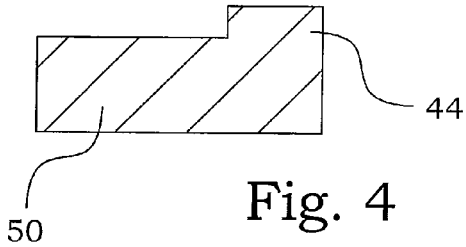
FIG. 4 is a cross-section A-A of the deflector arrangement of FIG. 3.

FIG. 4 illustrates a cross-sectional view of the coarse bar 44 of FIG. 3. It can here be noted that in this embodiment, the deflector arrangement 50 has a height that is less than a height of the respective coarse bar 44.

The refining discs are typically built-up by different refining segments. If the refining segments are designed as e.g. indicated by FIG. 1, the intended result is obtained for the refiner. However, if the refining segments each having essentially only one bar pattern, the same result can be achieved by mounting different such refining segments with different bar patterns juxtaposed to each other. Coarse bars of the less dense pattern can then in analogy with FIG. 1 be provided with deflector arrangement 50. A refining disc, composed by individual refining segments, can thus be provided with deflector arrangement 50 according to the present invention even if each refining segment as such does not have all necessary features. The operation of the deflector arrangement 50 will in such a case not be effective until being mounted together with other refining segments.

It is known in some refining arrangements to use dams, see e.g. the U.S. Pat. No. 3,473,745. The purpose of such dams is to prohibit a radial flow between the bars. The dams are typically provided with a sloping surface facing the flow for forcing the pulp up to the region between the refiner discs. Such dams are thus not functioning for directing a flow of fibrous material away from the bar surface in the intended relative rotational direction.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A refining segment for refiners of disc-type for working fibrous material, comprising:

a first portion having a first pattern of coarse bars;

a second portion having a second pattern of fine bars;

the second portion being positioned outside the first portion in a radial direction;

the second pattern having a higher density of bars than the first pattern, at least one deflector arrangement protruding from a bar surface of one of the coarse bars, the bar surface facing a relative rotational direction;

the deflector arrangement having a deflector surface and, in the relative rotational direction, a free end; and the deflector surface being arranged for directing a flow of fibrous material away, in the relative rotational direction, from the bar surface past the free end of the deflector arrangement.

2. A refining segment according to claim 1, wherein each coarse bar is provided with a deflector arrangement.

3. A refining segment according to claim 1 wherein the deflector arrangement ends at a distance in the radial direction from the second portion.

4. A refining segment according to claim 1 wherein the deflector arrangement protrudes a distance perpendicular to the bar surface, the distance perpendicular to the bar surface being in an interval between ¼ and ¾ of a distance between the coarse bar and an, in the relative rotational direction, adjacent coarse bar.

5. A refining segment according to claim 1 wherein at least a portion of the deflector surface has a tangential direction essentially aiming towards an outer end, in a radial direction, of an, in the relative rotational direction, adjacent coarse bar.

6. A refining segment according to claim 1 wherein the deflector surface is essentially plane.

7. A refining segment according to claim 1 wherein the deflector surface is concave.

8. A refining segment according to claim 1 wherein the deflector arrangement has a height that is less than a height of at least one of the coarse bars.

9. A refining apparatus for working of fibrous material, having two opposing refining discs rotatable in relation to each other, the two opposing refining discs having a refiner gap defined therebetween, at least one of the two refining discs comprising:

a first portion having a first pattern of coarse bars;

a second portion having a second pattern of fine bars;

the second portion being positioned outside the first portion in a radial direction;

the second pattern having a higher density of bars than the first pattern, at least one deflector arrangement, protruding from a bar surface of one of the coarse bars, the bar surface facing a relative rotational direction;

the deflector arrangement having a deflector surface and, in the relative rotational direction, a free end; and the deflector surface being arranged for directing a flow of fibrous material away, in the relative rotational direction, from the bar surface past the free end of the deflector arrangement.

10. A rotatable refining segment for refiners of disc-type for working fibrous material, comprising:

a first portion having a first pattern of coarse bars;

a second portion having a second pattern of fine bars;

the second portion being positioned outside the first portion in a radial direction;

the second pattern having a higher density of bars than the first pattern, a deflector arrangement protruding from a bar surface of one of the coarse bars, the deflector arrangement terminating at a free end away from the bar surface; and the deflector arrangement having means for directing a flow of fibrous material in a rotational direction past the free end.

11. The refining segment according to claim 10 wherein one of the coarse bars has a deflector arrangement that extends in the rotational direction away from the bar surface of said one of the coarse bars.

12. The refining segment according to claim 10 wherein one of the coarse bars has a deflector arrangement that is substantially perpendicular to the bar surface of said one of the coarse bars.

13. The refining segment according to claim 10 wherein one of the coarse bars has a deflector arrangement that extends towards an outer end of a coarse bar that is adjacent to said one of the coarse bars.

14. The refining segment according to claim 13 wherein the free end and the outer end having a free space defined therebetween.

15. The refining segment according to claim 10 wherein the free end on the deflector arrangement is directed substantially in the rotational direction.

* * * * *